US010240904B2

(12) United States Patent
Lindner

(10) Patent No.: US 10,240,904 B2
(45) Date of Patent: Mar. 26, 2019

(54) BULLET TRAP SYSTEMS AND METHODS OF USING THE SAME

(71) Applicant: D5 Iron Works, Inc., Woodstock, IL (US)

(72) Inventor: Richard Lindner, Crystal Lake, IL (US)

(73) Assignee: D5 Iron Works, Inc., Marengo, IL (US)

( * ) Notice: Subject to any disclaimer, the term of this patent is extended or adjusted under 35 U.S.C. 154(b) by 0 days.

(21) Appl. No.: 15/454,295

(22) Filed: Mar. 9, 2017

(65) Prior Publication Data

US 2018/0259305 A1 Sep. 13, 2018

(51) Int. Cl.
*F41J 13/00* (2009.01)
*F41J 13/02* (2009.01)

(52) U.S. Cl.
CPC ..... *F41J 13/00* (2013.01); *F41J 13/02* (2013.01)

(58) Field of Classification Search
CPC ..... F41J 13/00; F41J 13/02
USPC ..... 273/404, 410
See application file for complete search history.

(56) References Cited

U.S. PATENT DOCUMENTS 5,400,692 A 3/1995 Bateman
5,811,718 A * 9/1998 Bateman ..... F41J 13/00 273/394
7,194,944 B2 3/2007 Lambert et al.
7,275,748 B2 10/2007 Lambert et al.
7,306,230 B2 12/2007 Lambert et al.
7,434,811 B1 * 10/2008 Coburn ..... F41J 11/00 273/404
7,503,250 B2 3/2009 Lambert et al.
7,653,979 B2 2/2010 Bateman et al.
7,775,526 B1 8/2010 Lambert et al.
7,793,937 B2 9/2010 Bateman et al.
8,091,896 B2 1/2012 Lambert et al.
8,128,094 B2 3/2012 Bateman et al.
8,276,916 B2 10/2012 Bateman et al.
8,459,651 B1 * 6/2013 Nester ..... F41J 13/00 273/410
8,485,529 B2 7/2013 Bateman et al.
8,602,418 B1 * 12/2013 Hering ..... F41J 13/00 273/410
9,228,810 B2 1/2016 Bateman et al.
2007/0102883 A1 * 5/2007 Parks ..... F41J 13/00 273/348
2009/0096173 A1 * 4/2009 Bateman ..... B23K 11/0053 273/410
2013/0307218 A1 * 11/2013 Lamothe ..... F41J 13/00 273/410

* cited by examiner

*Primary Examiner* — Mark S Graham
(74) *Attorney, Agent, or Firm* — Scherrer Patent & Trademark Law, P.C.; Stephen T. Scherrer; Monique A. Morneault

(57) ABSTRACT

Bullet trap systems receive projectiles fired thereinto and allow for the recovery of the projectiles. Specifically, the bullet trap systems include strategically-placed support structures for ensuring that the projectile entry path remains unblocked and further includes sidewalls in the projectile containment units to prevent traveling of projectiles within the projectile containment units to prevent or minimize damage within the projectile containment units. Moreover, one or more accessibility hatches may be provided to allow individuals to gain access to the interior of the bullet trap systems.

21 Claims, 8 Drawing Sheets

BULLET TRAP SYSTEMS AND METHODS OF USING THE SAME

TECHNICAL FIELD

The present invention relates to bullet trap systems for receiving projectiles fired thereinto and for recovering the projectiles. Specifically, the bullet trap systems include strategically-placed support structures for ensuring that the projectile entry path remains unblocked and further includes sidewalls in the projectile containment units to prevent traveling of projectiles within the projectile containment units to prevent or minimize damage within the projectile containment units. Moreover, one or more accessibility hatches may be provided to allow individuals to gain access to the interior of the bullet trap systems.

BACKGROUND

Bullet traps are generally utilized to capture projectiles at firing ranges and to prevent the escape of the projectiles, many of which contain hazardous materials, such as lead, to thereby prevent contamination of the surrounding environment and for safety. Indeed, lead, one of the prominent materials utilized in projectiles for its weight and malleability, has been linked to many health problems in humans. For example, in children, exposure to lead may result in behavior and learning problems, including lower IQ and hyperactivity, slowed growth, hearing problems and anemia, to name a few. In pregnant women, lead can cross the placenta barrier, causing growth reduction of the fetus and premature birth. In adults, lead is linked to cardiovascular effects, increased blood pressure and incidence of hypertension, decreased kidney function and reproduction problems in both men and women.

Thus, bullet traps to capture projectiles and prevent contamination of the surrounding environment are being used more frequently. Indeed, it is necessary for law enforcement and others who utilize firearms to maintain their skills with the firearms, and the use of firing ranges can often be helpful and useful. Bullet traps have effectively replaced dirt mounds to provide safety and security of the projectiles fired from the firearms at these locations.

A bullet trap, typically, has several parts or features. First, a typical bullet trap has an opening through which the projectile enters. The opening, often referred to as the "mouth" typically is positioned at the end of a channel formed by an upper angled plate and a lower angled plate, arranged at complementary acute angles to the generally horizontal path that a projectile will typically travel. Thus, the channel is formed with a wide opening on one end and decreases in size to the mouth at the other end. The mouth is typically only a few inches high. A projectile may impact the plates of the channel and ricochet toward the mouth.

Upon entry to the mouth, the projectile typically travels down a relatively narrow channel known as the "throat". Exiting the throat, the projectile typically enters a barrel-shaped chamber, known as a "deceleration chamber", where the projectile may further ricochet around the chamber in a circular manner until it loses its momentum and falls, by gravity, through an aperture into a collection chamber.

It is often desirable to minimize or eliminate deflecting structures within a projectile's path in order to ensure that the projectile maintains its forward line of travel through the channel, into the mouth, and through the throat into the deceleration chamber. Therefore, it is generally known to eliminate any deflecting structures that may cause a projectile to deflect and ricochet back out of the bullet trap. Thus, it is highly desired to ensure that the projectile stays within the bullet trap and is collected within the collection chamber. Any projectile that is able to escape the bullet trap, such as a projectile that may deflect back out of the bullet trap, may pose a hazard to firearms users or others nearby, and to the environment.

The difficulty is that in the effort to eliminate all possible deflecting structures, bullet traps often are not structurally sound, especially in the area of the mouth and throat, and there is risk of collapse of the same, thereby causing damage and increasing the potential for deflections and escape of the projectiles. A need, therefore, exists for bullet trap systems that are structurally sound. Specifically, a need exists for bullet trap systems that prevent or minimize the possibility of collapse of the mouth and/or throat portions of the bullet trap systems. More specifically, a need exists for bullet trap systems that prevents or minimizes the escape of projectiles from the bullet trap systems yet still ensures that projectiles are not deflected out of the same.

In addition, bullet traps are often disposed side-by-side in a long series to provide users with many places to stand and fire their firearm into the trap. To prevent the aforementioned possibility of deflection, bullet traps that are lined up side-by-side to not have sidewalls within sections that bullets travel. Oftentimes, targets are set up at various locations within the channel of the bullet traps. Therefore, cross-firing of projectiles to hit targets that may be further away or at oblique angles to the shooter may cause projectiles to enter the bullet traps at extreme angles, instead of perpendicular to the mouth opening. Therefore, projectiles may also travel from one containment unit to another laterally during deceleration of the projectile within the decelerations chambers. Lateral traveling of projectiles within the deceleration chambers may cause damage to the deceleration chambers as bullets and bullet fragments traverse from one deceleration chamber to another. Moreover, projectiles fired at angles may eventually impact the terminal sidewalls of the bullet traps, causing damage to the terminal sidewalls thereof. A need, therefore, exists for bullet trap systems that minimize or prevent the lateral movement of projectiles. Specifically, a need exists for bullet trap systems that minimize or prevent the lateral movement of projectiles caused by cross-firing of the projectiles. Indeed, a need exists for bullet trap systems that minimize or prevent damage to containment units that may be caused by laterally moving projectiles cause by cross-filing of the projectiles.

Bullet traps often suffer from accumulation of bullet pieces and metal fragments. As projectiles enter the bullet traps, they may impact surfaces at high velocities, causing metals and metal fragments to spread along the interior surface of the bullet traps without falling into the collection chambers. In addition, bullets may enter bullet traps at high temperatures after being fired from firearms, or may heat up within the bullet traps and, especially, the deceleration chambers therein. Therefore, the metal or metal fragments may melt, spread out, and stick to interior surfaces of the bullet traps. Thus, a need exists for bullet trap systems that minimize or prevent damage to containment units that may be caused by melted metals and high temperature bullet fragments. A need further exists for bullet trap systems that provide accessibility to the interior of the bullet trap system, such as the deceleration chamber, for removing bullet fragments and pieces from within the bullet trap systems.

SUMMARY OF THE INVENTION

The present invention relates to bullet trap systems for receiving projectiles fired thereinto and for recovering the projectiles. Specifically, the bullet trap systems include strategically-placed support structures for ensuring that the projectile entry path remains unblocked and further includes sidewalls in the projectile containment units to prevent traveling of projectiles within the projectile containment units to prevent or minimize damage within the projectile containment units. Moreover, one or more accessibility hatches may be provided to allow individuals to gain access to the interior of the bullet trap systems.

To this end, in an embodiment of the present invention, a bullet trap system for decelerating and collecting projectiles is provided. The bullet trap system comprises: a channel comprising an upper angled plate and a lower angled plate, wherein the upper angled plate and the lower angled plate have a wide-open end on a front thereof and a narrow end at the rear thereof, wherein the narrow end forms a mouth for entry of projectiles; a throat extending from the mouth, wherein the throat channels projectiles therethrough; a deceleration chamber comprising an arcuately-shaped rear surface and an arcuately shaped front surface, the deceleration chamber formed from a plurality of deceleration chamber units joined together end-to-end; and a downwardly angled impact plate extending from a terminal end of the throat and positioned at a top of the deceleration chamber, wherein the mouth comprises no vertically-disposed elements and is open from a first end to a second end of the bullet trap system, wherein the throat comprises at least one vertical structure support element extending from the top of the deceleration chamber to a bottom surface of the throat.

In an embodiment, the vertical structure support element comprises a bolt.

In an embodiment, the vertical structure support element is adjustable in length vertically.

In an embodiment, the vertical structure support element comprises a terminal end extending through the top of the deceleration chamber and is accessible from outside the deceleration chamber.

In an embodiment, the bullet trap system further comprises a plurality of vertical support elements disposed extending from the top of the deceleration chamber to the bottom surface of the throat.

In an embodiment, the deceleration chamber units have joints therebetween, and each of the plurality of vertical support elements is positioned in close proximity to each of the joints.

In an embodiment, the vertical structure support element extends from a front end of the impact plate to the bottom surface of the throat.

In an alternate embodiment of the present invention, a bullet trap system for decelerating and collecting projectiles is provided. The bullet trap system comprises: a channel comprising an upper angled plate and a lower angled plate, wherein the upper angled plate and the lower angled plate have a wide-open end on a front thereof and a narrow end at the rear thereof, wherein the narrow end forms a mouth for entry of projectiles; a throat extending from the mouth, wherein the throat channels projectiles therethrough; and a deceleration chamber comprising an arcuately-shaped rear surface and an arcuately shaped front surface, the deceleration chamber formed from a plurality of deceleration chamber units joined together end-to-end, wherein the mouth comprises no vertically-disposed elements and is open from a first end to a second end of the bullet trap system; and a wall extending from the arcuately-shaped rear surface between side ends of the deceleration chamber, and extending at least partially within the deceleration chamber.

In an embodiment, the wall is positioned vertically along the arcuately-shaped rear surface of the deceleration chamber.

In an embodiment, the wall comprises a vertically-disposed tapered fin extending from the arcuately-shaped rear surface of the deceleration chamber.

In an embodiment, the wall extends entirely from the arcuately-shaped rear surface to the arcuately-shaped front surface of the deceleration chamber.

In an embodiment, the wall extends only partially within the deceleration chamber from the arcuately-shaped rear surface of the deceleration chamber.

In an embodiment, the arcuately shaped rear surface of the deceleration chamber comprises an upper section surface and a lower section surface, and the wall extends from only the lower section surface.

In an embodiment, the bullet trap system further comprises: a plurality of walls disposed at positions along the rear surface of the deceleration chamber from the first end to the second end of the deceleration chamber In an embodiment, the deceleration chamber units have joints therebetween, and each of the plurality of walls is positioned at each of the joints between the deceleration chamber units.

In yet another alternate embodiment of the present invention, a bullet trap system for decelerating and collecting projectiles is provided. The bullet trap system comprises: a channel comprising an upper angled plate and a lower angled plate, wherein the upper angled plate and the lower angled plate have a wide-open end on a front thereof and a narrow end at the rear thereof, wherein the narrow end forms a mouth for entry of projectiles; a throat extending from the mouth, wherein the throat channels projectiles therethrough; a deceleration chamber comprising an arcuately-shaped rear surface and an arcuately shaped front surface, the deceleration chamber formed from a plurality of deceleration chamber units joined together end-to-end, wherein a removable section of the arcuately-shaped rear surface is removable to obtain access to an interior of the deceleration chamber, wherein the removable section comprises at least one handle for removing the same.

In an embodiment, the arcuately-shaped rear surface comprises an upper section and a lower section that are joined together to form the arcuately-shaped rear surface, wherein the removable section is disposed in the upper section.

In an embodiment, the arcuately-shaped rear surface comprises an upper section and a lower section that are joined together to form the arcuately-shaped rear surface, wherein the removable section is the upper section.

In an embodiment, each of the deceleration chamber units forming the deceleration chamber comprises a rear surface, wherein each of the deceleration chamber units comprises a removable section within each of the rear surfaces thereof.

In an embodiment, each of the rear surfaces of each of the deceleration chamber units comprises an upper section and a lower section that are joined together to form the rear surface thereof, wherein the removable section is the upper section.

It is, therefore, an advantage and objective of the present invention to provide bullet trap systems that are structurally sound.

Specifically, it is an advantage and objective of the present invention to provide bullet trap systems that prevent or minimize the possibility of collapse of the mouth and/or throat portions of the bullet trap systems.

More specifically, it is an advantage and objective of the present invention to provide bullet trap systems that prevents or minimizes the escape of projectiles from the bullet trap systems yet still ensures that projectiles are not deflected out of the same.

In addition, it is an advantage and objective of the present invention to provide bullet trap systems that minimize or prevent the lateral movement of projectiles.

Specifically, it is an advantage and objective of the present invention to provide bullet trap systems that minimize or prevent the lateral movement of projectiles caused by cross-firing of the projectiles.

Indeed, it is an advantage and objective of the present invention to provide bullet trap systems that minimize or prevent damage to containment units that may be caused by laterally moving projectiles cause by cross-filing of the projectiles.

Further, it is an advantage and objective of the present invention to provide bullet trap systems that minimize or prevent damage to containment units that may be caused by melted metals and high temperature bullet fragments.

Moreover, it is an advantage and objective of the present invention to provide bullet trap systems that provide accessibility to the interior of the bullet trap system, such as the deceleration chamber, for removing bullet fragments and pieces from within the bullet trap systems.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to bullet trap systems for receiving projectiles fired thereinto and for recovering the projectiles. Specifically, the bullet trap systems include strategically-placed support structures for ensuring that the projectile entry path remains unblocked and further includes sidewalls in the projectile containment units to prevent traveling of projectiles within the projectile containment units to prevent or minimize damage within the projectile containment units. Moreover, one or more accessibility hatches may be provided to allow individuals to gain access to the interior of the bullet trap systems.

Figure 1:
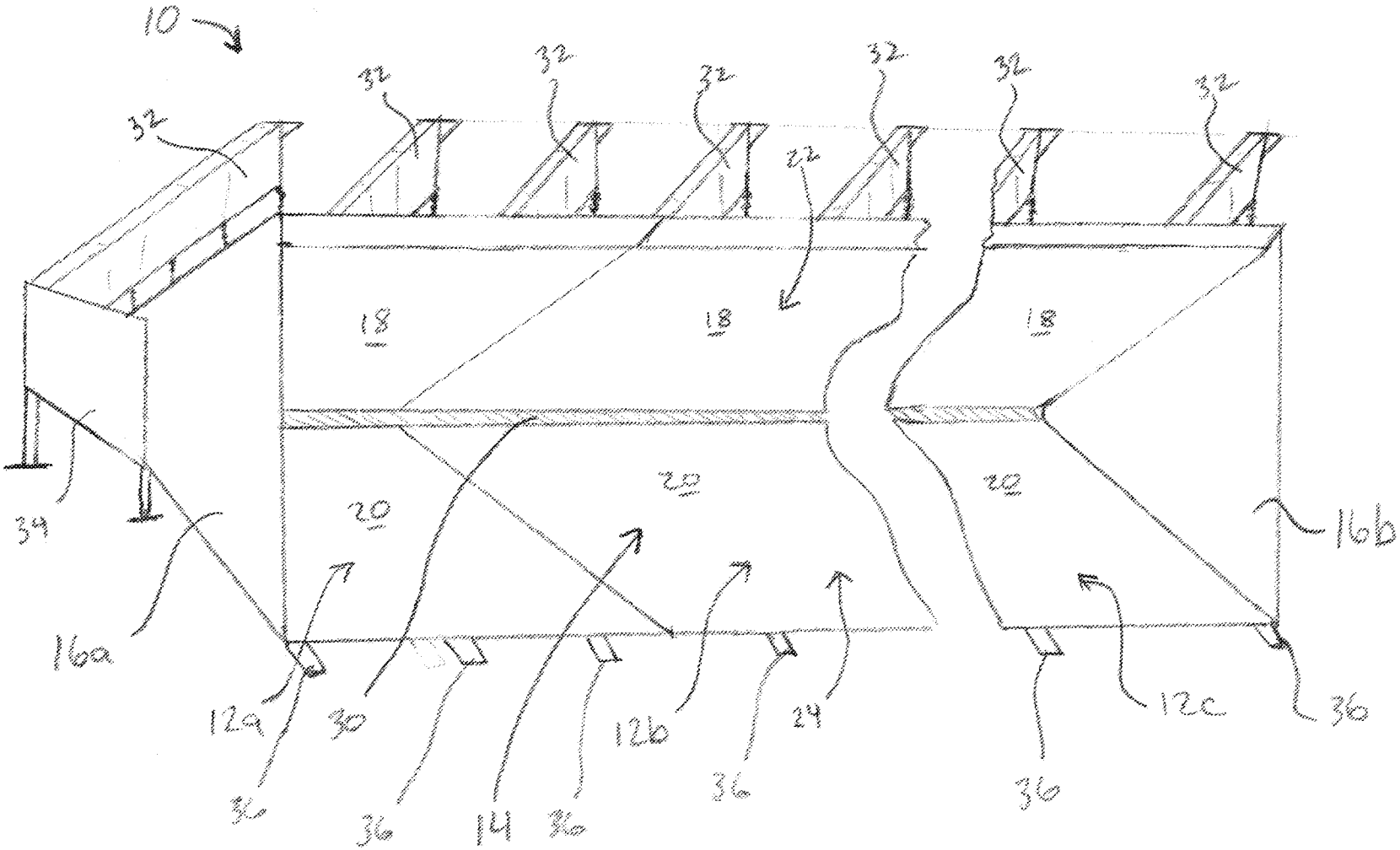
FIG. 1 illustrates a perspective view of a bullet trap system in an embodiment of the present invention.

Now referring to the figures, wherein like numerals refer to like parts, FIG. 1 illustrates a bullet trap system 10 in an embodiment of the present invention. The bullet trap system comprises a plurality of bullet trap sections 12*a*, 12*b*, 12*c* that are disposed side-by-side to provide a wide, uninterrupted bullet trap opening 14 at which to fire bullets and other projectiles. As shown in FIG. 1, bullet trap section 12*a* may include a sidewall 16*a* disposed on a left side thereof, when facing the opening 14 from a front thereof, and the bullet trap section 12*c* may include a sidewall 16*b* disposed on a right side thereof, when facing the opening 14 from a front thereof. Section 12*b*, and other subsequent bullet trap sections, disposed between sidewalls 12*a* and 12*c*, also referred to herein as middle bullet trap sections, may not have sidewalls so as to form the uninterrupted opening 14. Therefore, although FIG. 1 is illustrated with the bullet trap sections 12*a*, 12*b* and 12*c*, it should be noted that any number of middle bullet trap sections may be disposed between bullet trap sections 12*a*, 12*c* and the bullet trap system 10 may be as wide as is desired and necessary.

Each bullet trap section 12*a*, 12*b*, 12*c* may have an upper angled plate 18 and a lower angled plate 20, thereby forming a V-shaped opening from sidewall 16*a* to sidewall 16*b*. The upper angled plates 18 may be disposed side-by-side and seamed, thereby forming a wide upper angled plate surface 22 and the lower angled plates 20 may be disposed side-by-side forming a wide lower angled plate surface 24. As projectiles enter the wide opening 14, they may ricochet off of one or the other of the upper angled plate surface 22 and the lower angled plate surface 24, funneled into mouth 30 that may be formed between terminal ends of the wide upper angled plate surface 22 and the wide lower angled plate surface 24. The projectiles may thus be directed into the interior of the bullet trap system 10 for deceleration and collection.

The upper angled plates 18 may be supported by structural beams 32 that may be cantilevered over the upper angled plates 18, thereby holding up the upper angled plates 18 and preventing collapse of the same. Disposed on side ends at a rear of the bullet trap system may be deceleration chamber sidewalls 34, disposed on opposite terminal ends of the deceleration chamber, as illustrated below, to prevent escape of projectiles from the sides of the deceleration chamber. Footer beams 36 may be disposed beneath lower angled plates 20, thereby supporting the same.

Figure 2:
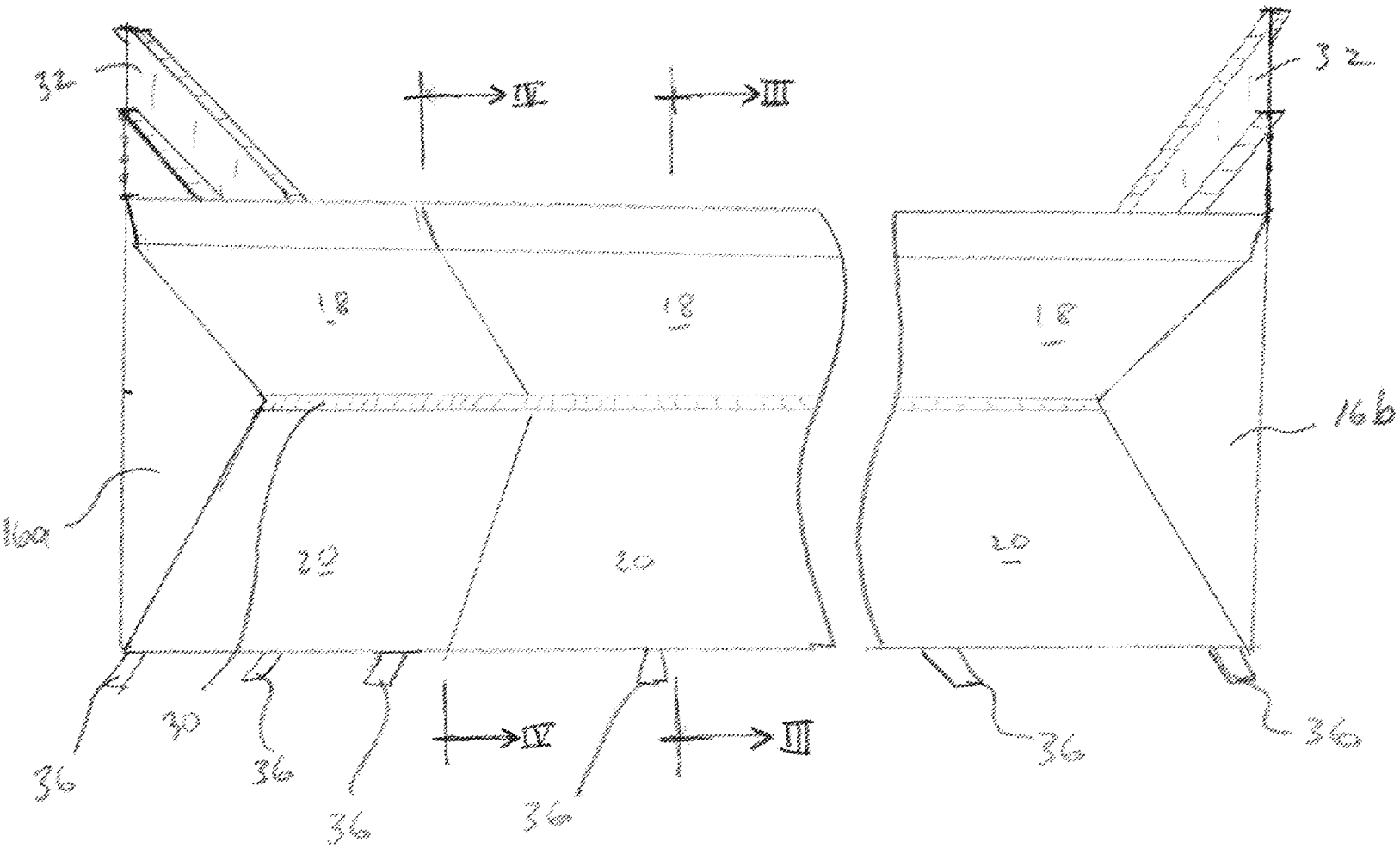
FIG. 2 illustrates a front view of a bullet trap system in an embodiment of the present invention.
Figure 3:
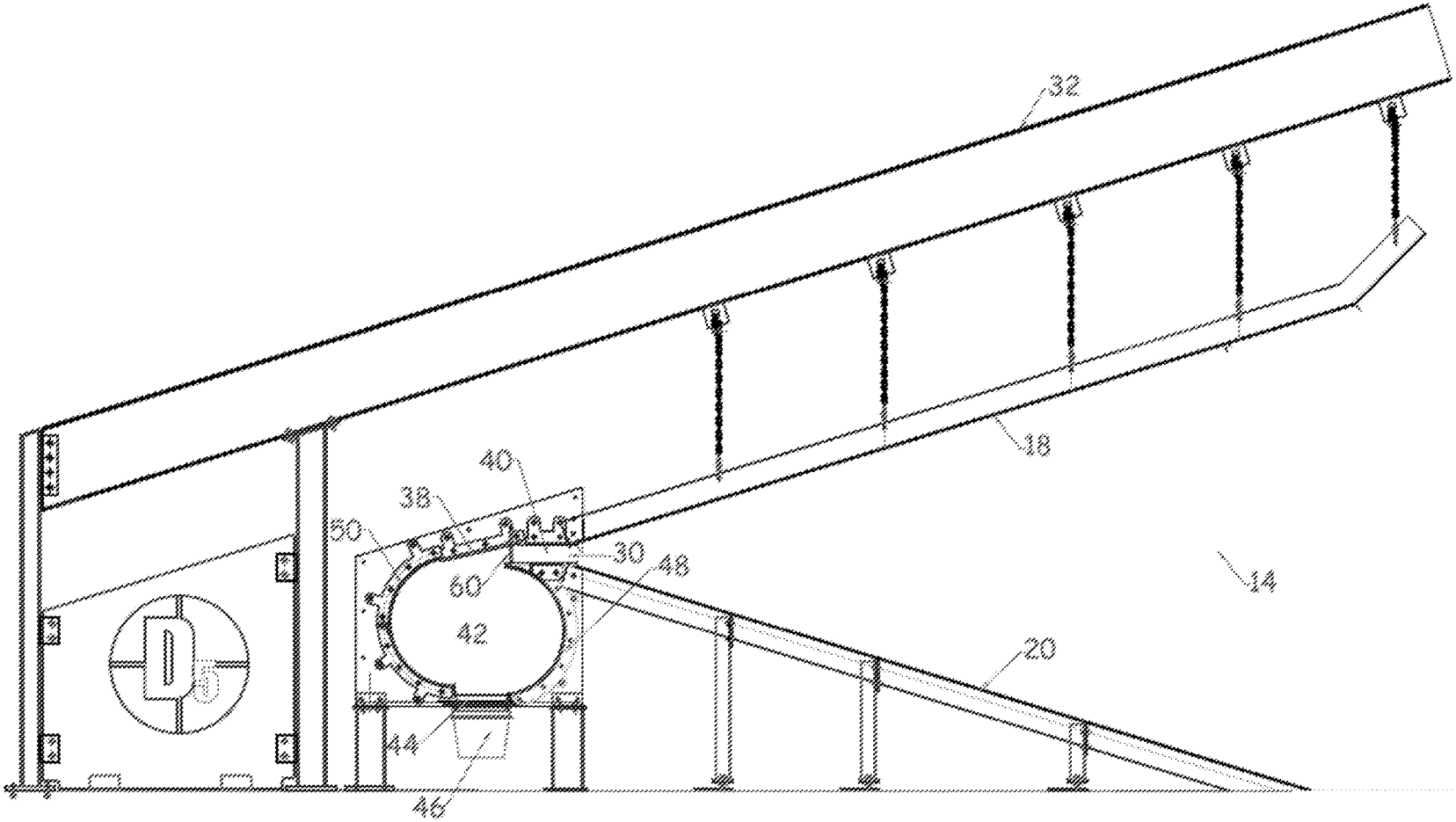
FIG. 3 illustrates a cross-sectional-view of a bullet trap system along lines III-III of FIG. 2 in an embodiment of the present invention.

FIG. 3 illustrates a side cross-sectional view along lines III-III of FIG. 2, showing the wide opening 14 formed by upper plate 18 and lower plate 20, which form a V-shaped funnel portion having the mouth 30 at terminal ends thereof. As a projectile enters mouth 30, it may travel down throat 40, strike impact plate 38 and into deceleration chamber 42, whereupon the projectile may travel in a circular trajectory around the perimeter of the deceleration chamber 42 until it loses its energy of motion and falls through opening 44 into collection chamber 46. The perimeter of the deceleration chamber 42 may comprise a front arcuate steel surface 48 and a rear arcuate steel surface 50, although the materials utilized may be any as apparent to one of ordinary skill in the art.

Figure 4:
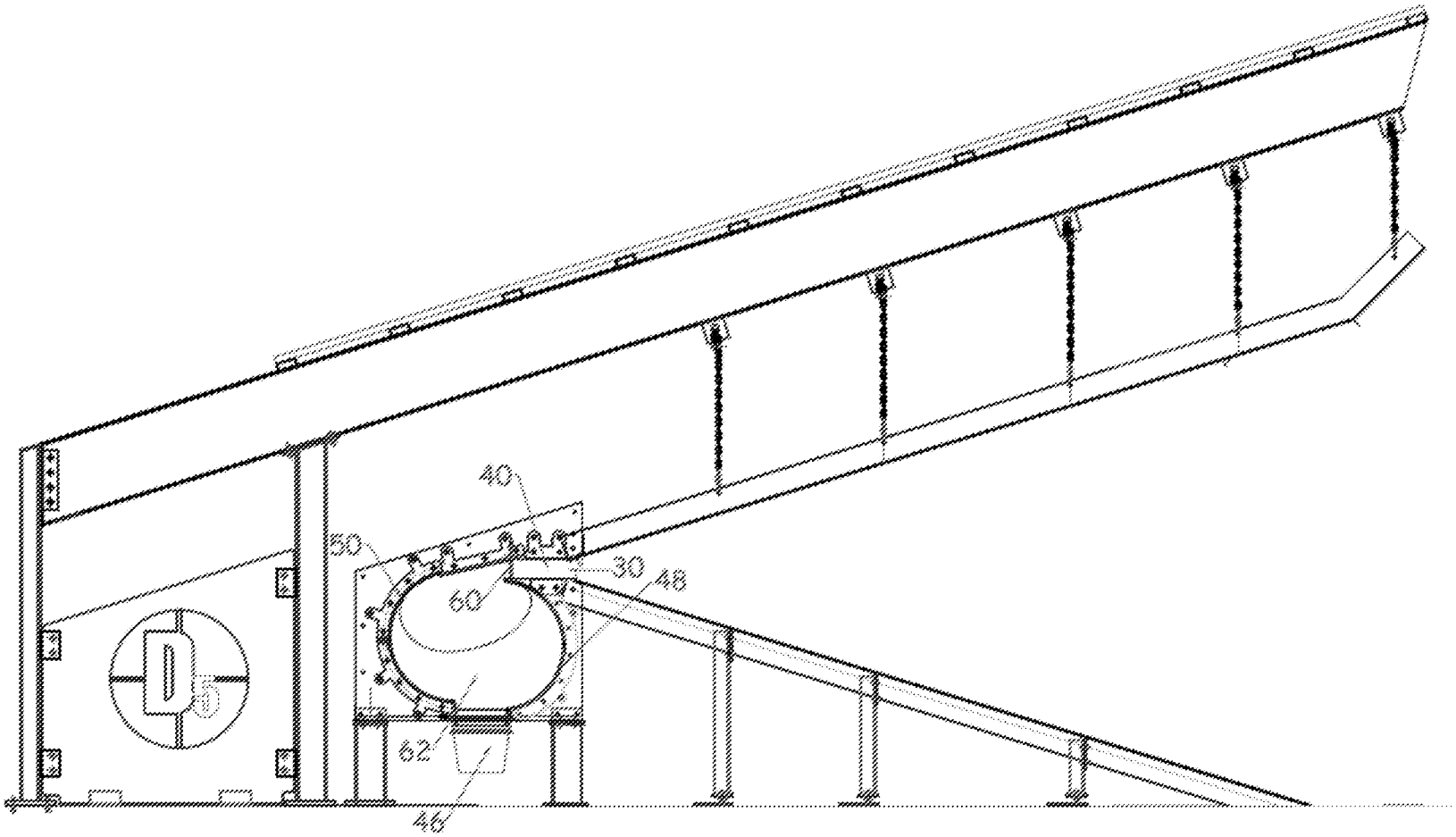
FIG. 4 illustrates a cross-sectional view of a bullet trap system along lines IV-IV of FIG. 2 in an embodiment of the present invention.
Figure 5:
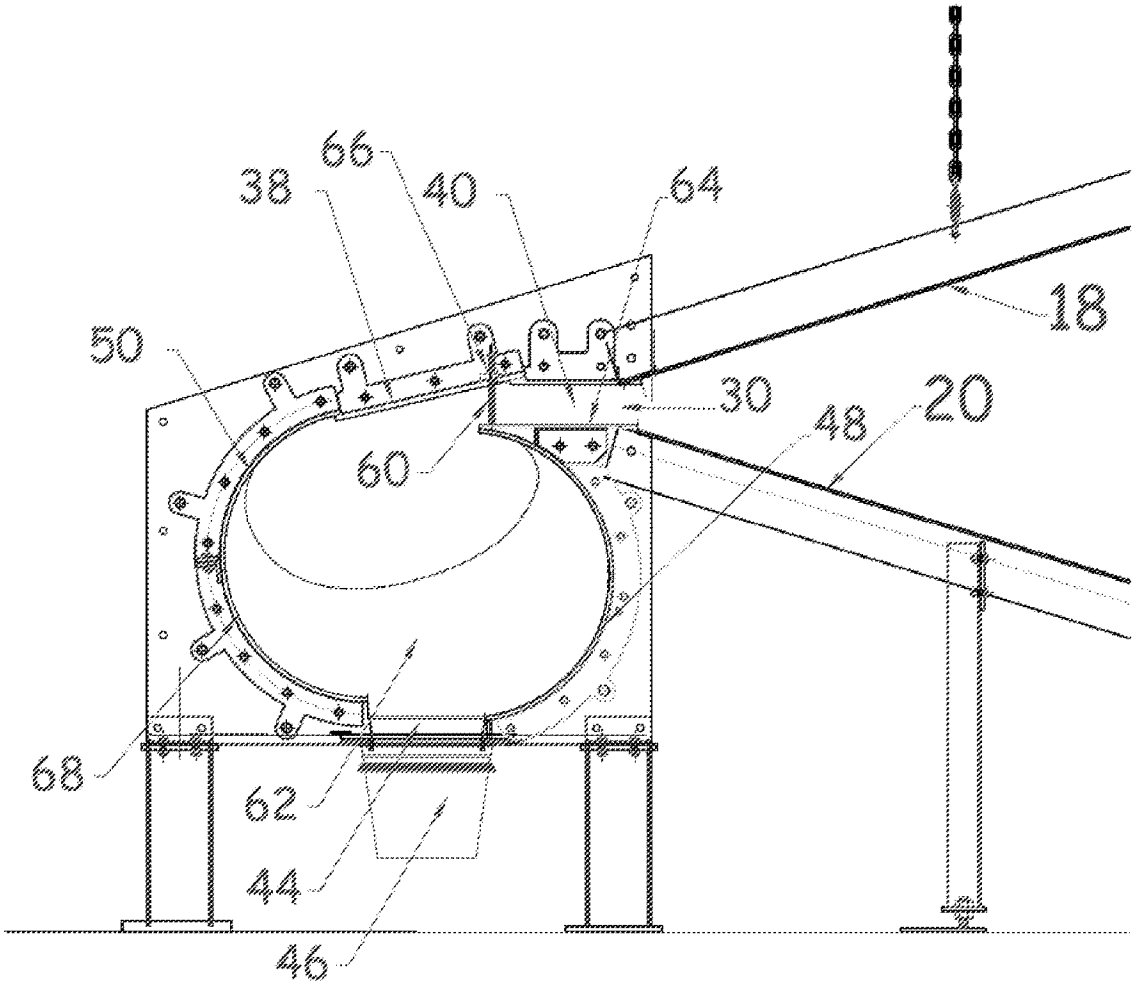
FIG. 5 illustrates a close-up view of a bullet trap system deceleration chamber in an embodiment of the present invention.

The cross-sectional view of FIG. 3, as viewed along line III-III may illustrate the bullet trap system 10 at bullet trap section 12*b* within a middle thereof. FIG. 4, on the other hand, illustrates a cross-sectional view of bullet trap system 10 along line IV-IV that illustrates the bullet trap system 10 at the junction between bullet trap sections 12*a*, 12*b* (or at junctions between any bullet trap sections). The deceleration chamber 42 may comprise a plurality of deceleration chamber units that are disposed in end-to-end, side-by-side fashion. At the junction between bullet trap sections 12*a*, 12*b*, and thereby at the junction between deceleration chamber units thereof, a structure support element 60 may be disposed within the throat 40. A close-up view of the deceleration chamber 42 of the cross-sectional view shown in FIG. 4 is illustrated in FIG. 5 for better reference. The structure support element 60 may be an adjustable bolt or similar element that may descend from a top surface of the throat 40 and contact the bottom surface of the throat 40, thereby providing structural support of the throat 40 at the junction between bullet trap sections 12*a*, 12*b*, or any other bullet trap sections.

The structure support element 60 may be adjustable upwardly and downwardly depending on the extent of support necessary, and is provided to ensure that the throat maintains its open pathway for projectiles to traverse therethrough into deceleration chamber 42. Therefore, it is contemplated by the present invention that a structure support element 60 may be provided at each junction between bullet trap sections. Alternatively, structure support elements 60 may be provided in any location within throat 40 to provide structural support of the throat 40, ensuring that the path the projectile traverses remains open and clear. It is preferable that the structure support element 60 be as thin and/or diminutive as possible to minimize contact thereof by projectiles traversing through the throat 40, yet strong and structurally sound enough to provide adequate support within the throat 40.

Likewise, FIGS. 4 and 5 illustrate a deceleration chamber fin extension element 62 forming, in effect, a wall extending from rear surface 50 of the deceleration chamber 42. Preferably, fin extension element 62 is disposed within deceleration chamber 42 at junctions between deceleration chamber units, thereby maintaining deceleration chamber units as individual units separate from one another. The fin may be any size and may extend from the rear surface 50 in a manner that prevents or minimizes projectile travel through the deceleration chamber 42 from one chamber unit to another. Thus, the fin extension elements 62 may effectively block the projectile or fragments thereof from traveling laterally from one end of the deceleration chamber 42 to another. Therefore, the bullets, bullet fragments, pieces thereof, and other like projectiles may be contained within particular chamber units and collected within collection chambers 46 of the individual chamber units. Thus, because traveling of projectiles is minimized or prevented, damage to the deceleration chamber 42 or build-up of bullet fragments or elements thereof may be minimized or eliminated, providing for a better and cleaner bullet trap system.

As illustrated in FIG. 5, a close-up view of the deceleration chamber 42 is illustrated, showing the mouth 30, the throat 40, the impact plate 38, the front surface 48, the rear surface 50, the opening 44 and the collection chamber 46. As illustrated, the structure support element 60 is illustrated, disposed through an end of the impact plate and extending to a lower surface 64 of the throat 40 near the rear terminal end of the lower surface 64 and, thus, the throat 40. The structure support element 60 may have an end 66 that may be adjusted so that the structure support element 60 pushes against the lower surface 64 of the throat 40 and ensuring that the throat 40 remains open and clear for projectiles to traverse therethrough, providing stability and structural integrity to the throat 40.

Further, FIG. 5 illustrates a close-up view of fin extension element 62 extending from a lower section surface 68 of the rear surface 50 of the deceleration chamber 42. It should be noted that the fin extension element 62 may have any shape or size to block the lateral traversal of bullets, pieces and fragments throughout the deceleration chamber 42. For example, the fin extension element 62 may be disposed over almost the entirety of the cross-section of the deceleration chamber, as illustrated in FIG. 5, such as from the rear surface 50 to the front surface 48, thereby ensuring that each deceleration chamber unit maintains its separation from the other deceleration chamber units. However, it should be noted that it is desired to keep the mouth, the throat and even an upper portion of the deceleration chamber clear of walls or other like elements, except for the structure support element 60, so as to ensure that projectiles do not ricochet back out of the bullet trap, possibly causing damage or injury.

In a preferred embodiment, the rear surface 50 of the deceleration chamber 42 may comprise the lower section surface 68 and an upper section surface 70 that are joined together to form the entirety of the rear surface 50. Thus, the upper section surface 70 of the deceleration chamber 42 may be easily removable to provide easy access to the deceleration chamber 42, as detailed below.

Figure 6:
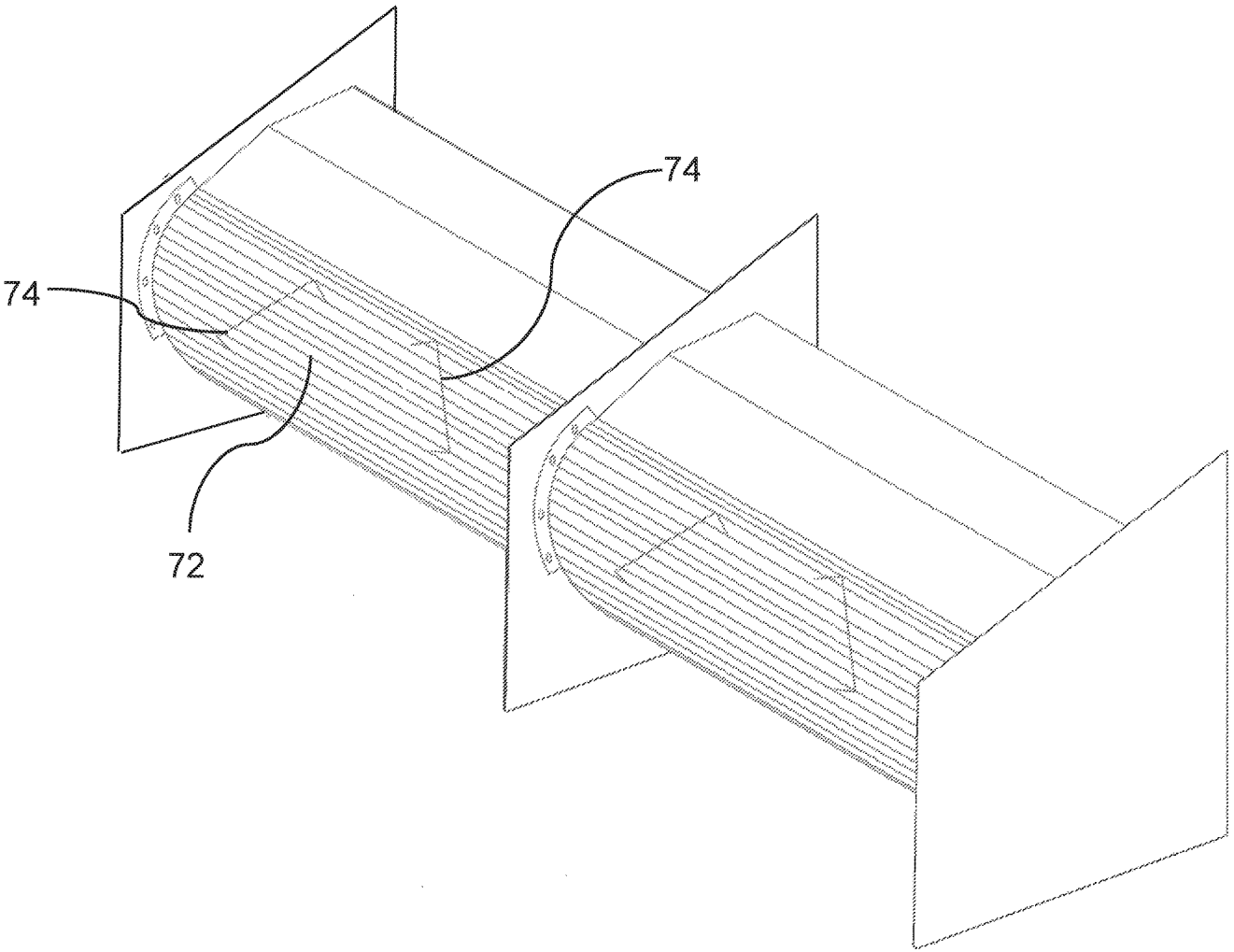
FIG. 6 illustrates a rear view of a bullet trap system, including the rear side of a deceleration chamber, in an embodiment of the present invention.
Figure 7:
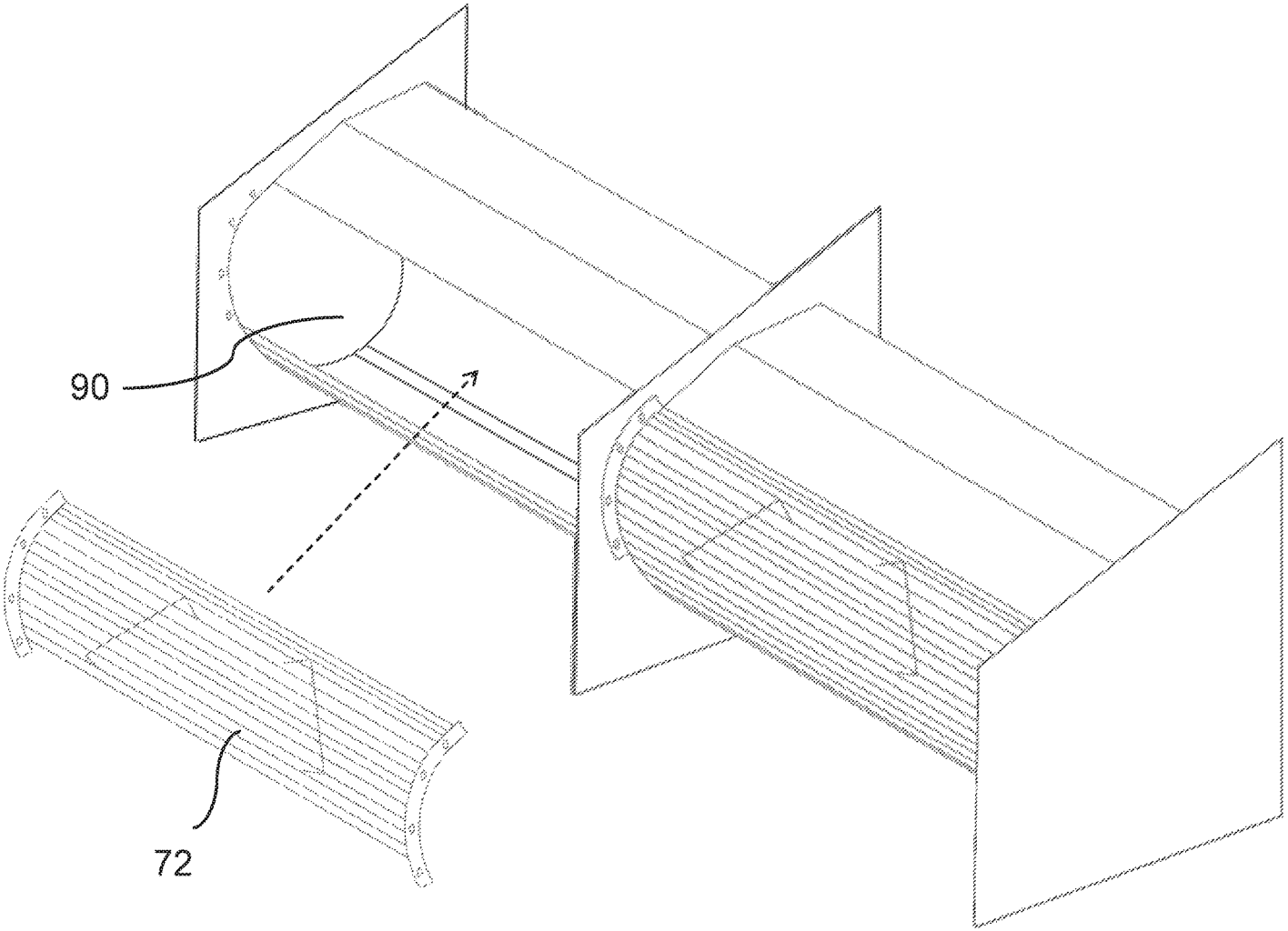
FIG. 7 illustrates a rear view of a bullet trap system, including the rear side of a deceleration chamber having an access hatch removed, in an embodiment of the present invention.
Figure 8:
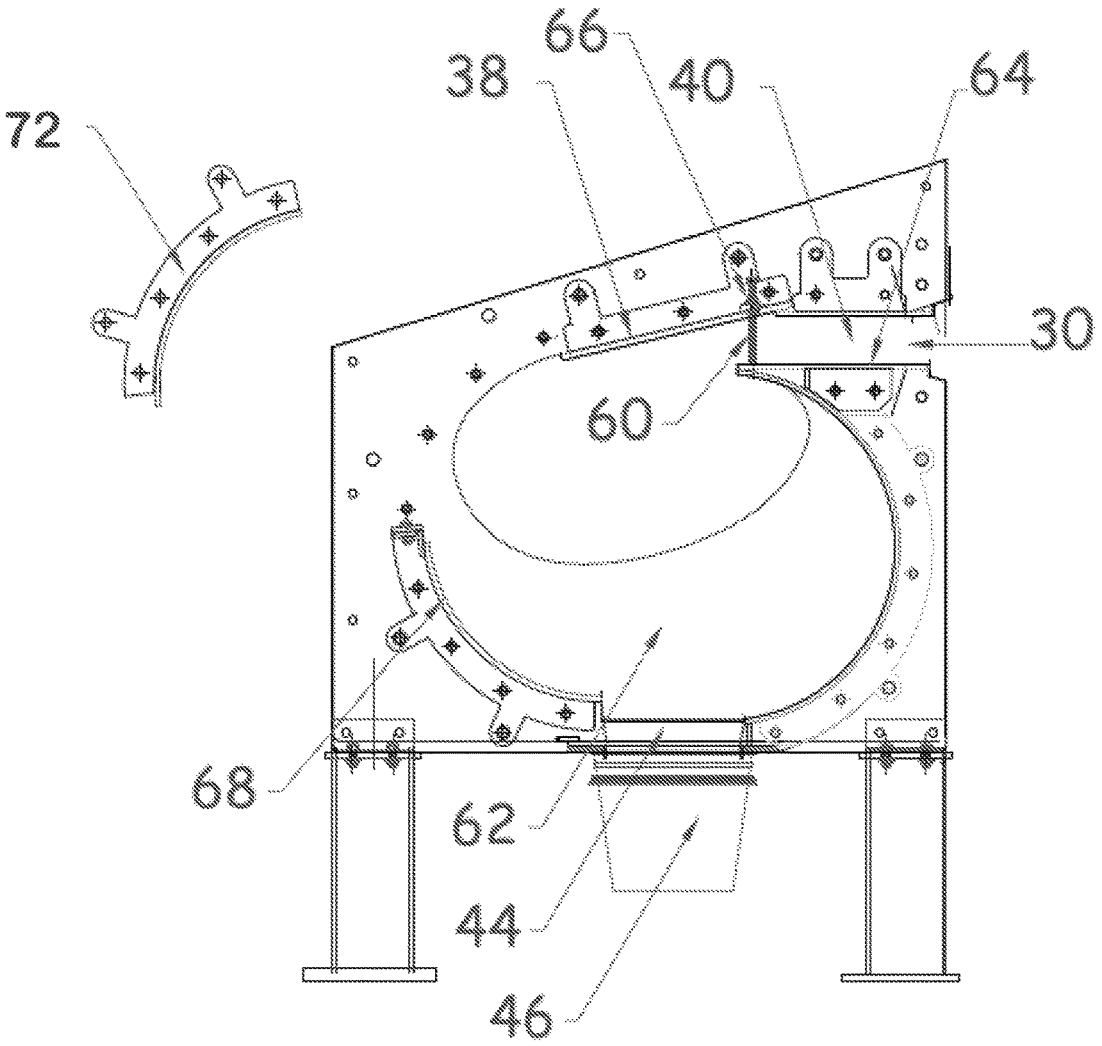
FIG. 8 illustrates a cross-sectional view of a bullet trap system deceleration chamber having a hatch removed for gaining access to an interior of the deceleration chamber in an embodiment of the present invention.

As illustrated in FIG. 6, a rear view of the bullet trap system 10, a back side plate 72 of the deceleration chamber 42 is illustrated. The back side plate 72 of the deceleration chamber 42 may have handles 74 thereon, and may be bolted thereto, providing the upper section surface 70 of the deceleration chamber 42 on an inside thereof. The back side plate 72 may thus be easily removable from a deceleration chamber unit of the deceleration chamber 42 to allow an individual to obtain internal access to the deceleration chamber for cleaning out the same and inspecting for damage. Specifically, an individual may remove the plurality of bolts holding the back side plate to the deceleration chamber unit and using the handles 74, may remove the back side plate 72, as illustrated in FIG. 7, providing access to the interior of the deceleration chamber unit through an entry port 90. FIG. 8 illustrates a cross-sectional view of the deceleration chamber 42 having the back side plate 72 removed therefrom, allowing the user easy access through the entry port 90 into the interior of the deceleration chamber 42.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A bullet trap system for decelerating and collecting projectiles comprising:

a channel comprising an upper angled plate and a lower angled plate, wherein the upper angled plate and the lower angled plate have a wide-open end on a front thereof and a narrow end at the rear thereof, wherein the narrow end forms a mouth for entry of projectiles;

a throat extending from the mouth, wherein the throat channels projectiles therethrough;

a deceleration chamber comprising an arcuately-shaped rear surface and an arcuately shaped front surface, the deceleration chamber formed from a plurality of deceleration chamber units joined together end-to-end, wherein the deceleration chamber comprises a first end wall on a first terminal end of the deceleration chamber and a second end wall on a second terminal end of the deceleration chamber and an open passage in the deceleration chamber from the first end wall to the second end wall, wherein the mouth comprises no vertically-disposed elements and is open between the first end wall on the first terminal end of the deceleration chamber and the second end wall on the second terminal end of the deceleration chamber of the bullet trap system, wherein the throat comprises at least one vertical structure support element extending from the top of the deceleration chamber to a bottom surface of the throat, wherein the vertical structure support element is adjustable in length vertically; and an intermediate wall extending from the arcuately-shaped rear surface between the first side end wall and the second side end wall of the deceleration chamber, and extending at least partially within the deceleration chamber.

2. The bullet trap system of claim 1 wherein the intermediate wall is positioned vertically along the arcuately-shaped rear surface of the deceleration chamber.

3. The bullet trap system of claim 1 wherein the intermediate wall comprises a vertically-disposed tapered fin extending from the arcuately-shaped rear surface of the deceleration chamber.

4. The bullet trap system of claim 1 wherein the intermediate wall extends entirely from the arcuately-shaped rear surface to the arcuately-shaped front surface of the deceleration chamber.

5. The bullet trap system of claim 1 wherein the intermediate wall extends only partially within the deceleration chamber from the arcuately-shaped rear surface of the deceleration chamber.

6. The bullet trap system of claim 1 wherein the arcuately shaped rear surface of the deceleration chamber comprises an upper section surface and a lower section surface, and the intermediate wall extends from only the lower section surface.

7. The bullet trap system of claim 1 further comprising a plurality of intermediate walls disposed at positions along the rear surface of the deceleration chamber from the first side end wall to the second side end wall of the deceleration chamber.

8. The bullet trap system of claim 7 wherein the deceleration chamber units have joints therebetween, and each of the plurality of intermediate walls is positioned at each of the joints between the deceleration chamber units.

9. A bullet trap system for decelerating and collecting projectiles comprising:

a channel comprising an upper angled plate and a lower angled plate, wherein the upper angled plate and the lower angled plate have a wide-open end on a front thereof and a narrow end at the rear thereof, wherein the narrow end forms a mouth for entry of projectiles;

a throat extending from the mouth, wherein the throat channels projectiles therethrough;

a deceleration chamber comprising an arcuately-shaped rear surface and an arcuately shaped front surface, the deceleration chamber formed from a plurality of deceleration chamber units joined together end-to-end, wherein the deceleration chamber comprises a first end wall on a first terminal end of the deceleration chamber and a second end wall on a second terminal end of the deceleration chamber and an open passage in the deceleration chamber from the first end wall to the second end wall, wherein a removable section of the arcuately-shaped rear surface is removable to obtain access to an interior of the deceleration chamber, wherein the removable section comprises at least one handle for removing the same, wherein the mouth comprises no vertically-disposed elements and is open between the first end wall on the first terminal end of the deceleration chamber and the second end wall on the second terminal end of the deceleration chamber of the bullet trap system, wherein the throat comprises at least one vertical structure support element extending from the top of the deceleration chamber to a bottom surface of the throat, wherein the vertical structure support element is adjustable in length vertically.

10. The bullet trap system of claim 9 wherein the arcuately-shaped rear surface comprises an upper section and a lower section that are joined together to form the arcuately-shaped rear surface, wherein the removable section is disposed in the upper section.

11. The bullet trap system of claim 9 wherein the arcuately-shaped rear surface comprises an upper section and a lower section that are joined together to form the arcuately-shaped rear surface, wherein the removable section is the upper section.

12. The bullet trap system of claim 9 wherein each of the deceleration chamber units forming the deceleration chamber comprises a rear surface, wherein each of the deceleration chamber units comprises a removable section within each of the rear surfaces thereof.

13. The bullet trap system of claim 12 wherein each of the rear surfaces of each of the deceleration chamber units comprises an upper section and a lower section that are joined together to form the rear surface thereof, wherein the removable section is the upper section.

14. A bullet trap system for decelerating and collecting projectiles comprising:

a channel comprising an upper angled plate and a lower angled plate, wherein the upper angled plate and the lower angled plate have a wide-open end on a front thereof and a narrow end at the rear thereof, wherein the narrow end forms a mouth for entry of projectiles;

a throat extending from the mouth, wherein the throat channels projectiles therethrough;

a deceleration chamber comprising an arcuately-shaped rear surface and an arcuately shaped front surface, the deceleration chamber formed from a plurality of deceleration chamber units joined together end-to-end; and a downwardly angled impact plate extending from a terminal end of the throat and positioned at a top of the deceleration chamber, wherein the mouth comprises no vertically-disposed elements and is open from a first end to a second end of the bullet trap system, wherein the throat comprises at least one vertical structure support element extending from the top of the deceleration chamber to a bottom surface of the throat, wherein the vertical structure support element is adjustable in length vertically.

15. The bullet trap system of claim 14 wherein the deceleration chamber comprises a first end wall on a first terminal end of the deceleration chamber and a second end wall on a second terminal end of the deceleration chamber and an open passage in the deceleration chamber from the first end wall to the second end wall.

16. The bullet trap system of claim 14 wherein the vertical structure support element comprises a bolt.

17. The bullet trap system of claim 14 wherein the vertical structure support element comprises a terminal end extending through the top of the deceleration chamber and is accessible from outside the deceleration chamber.

18. The bullet trap system of claim 14 further comprising a plurality of vertical support elements disposed extending from the top of the deceleration chamber to the bottom surface of the throat.

19. The bullet trap system of claim 18 wherein the deceleration chamber units have joints therebetween, and each of the plurality of vertical support elements is positioned in close proximity to each of the joints.

20. The bullet trap system of claim 14 wherein the vertical structure support element extends from a front end of the impact plate to the bottom surface of the throat.

21. A bullet trap system for decelerating and collecting projectiles comprising:

a channel comprising an upper angled plate and a lower angled plate, wherein the upper angled plate and the lower angled plate have a wide-open end on a front thereof and a narrow end at the rear thereof, wherein the narrow end forms a mouth for entry of projectiles;

a throat extending from the mouth, wherein the throat channels projectiles therethrough;

a deceleration chamber comprising an arcuately-shaped rear surface and an arcuately shaped front surface, the deceleration chamber formed from a plurality of deceleration chamber units joined together end-to-end; and a downwardly angled impact plate extending from a terminal end of the throat and positioned at a top of the deceleration chamber, wherein the mouth comprises no vertically-disposed elements and is open from a first end to a second end of the bullet trap system, wherein the vertical height of the throat is adjustable to maintain an open pathway for projectiles to traverse therethrough.

* * * * *